US006572185B1

(12) United States Patent
Tseng

(10) Patent No.: US 6,572,185 B1
(45) Date of Patent: Jun. 3, 2003

(54) CHAIR WITH AN EXTENDIBLE FOOTREST

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/217,302

(22) Filed: Aug. 12, 2002

(51) Int. Cl.[7] ..... A47C 1/038
(52) U.S. Cl. ..... 297/85; 297/69; 297/89
(58) Field of Search ..... 297/69, 85, 89, 297/423.26, 423.3

(56) References Cited

U.S. PATENT DOCUMENTS 2,999,720 A * 6/1961 Schliephacke ..... 297/89
3,169,035 A * 2/1965 Fletcher ..... 297/85
3,300,244 A * 1/1967 Hughes ..... 297/89
5,110,179 A * 5/1992 Rogers ..... 297/68
5,169,208 A * 12/1992 Re et al. ..... 297/85

* cited by examiner

*Primary Examiner*—Peter R. Brown
(74) *Attorney, Agent, or Firm*—Ladas & Parry

(57) ABSTRACT

A chair includes a seat mounted on a seat base, a backrest disposed rearwardly of the seat base, a footrest disposed frontwardly of the seat base, and a linkage unit interconnecting the footrest and the seat. The linkage unit includes a plurality pair of crank arms provided with at least one arm spacer therebetween as such the crank arms thereof do not clamp a user's finger when the crank arms are folded.

3 Claims, 6 Drawing Sheets

CHAIR WITH AN EXTENDIBLE FOOTREST

BACKGROUND OF THE INVENTION

1. Field of the Invention

The present invention relates to a chair, more particularly to a chair with an extendible footrest.

2. Description of the Related Art

A conventional chair includes a seat base, a seat disposed above the seat base, a footrest disposed frontwardly of the seat, a backrest disposed rearwardly of and pivoted to a rear end of the seat, and a linkage unit interconnecting the footrest and the seat. The linkage unit includes at least two pairs of pivotally connected crank arms which are movable between extended and retracted positions relative to the seat.

One disadvantage of the aforementioned conventional chair resides in that the crank arms of the linkage unit may accidentally clamp a user's finger when the crank arms are disposed at the retracted position.

SUMMARY OF THE INVENTION

Therefore, the object of this invention is to provide a chair having a linkage unit that interconnects a seat and a footrest and that has a plurality. of crank arms provided with an arm spacer therebetween such that the crank arms will not clamp the user's finger when the crank arms are disposed at a retracted position.

Accordingly, a chair of the present invention includes: a seat base; a seat mounted on the seat base, extending in longitudinal direction, and having left and right sides, front and rear ends, and a bottom; a backrest disposed rearwardly of and connected to the seat; a footrest disposed frontwardly of the seat; and a linkage mounting unit including left and right brackets fixed to the bottom of the seat and extending in the longitudinal direction. Each of the left and right brackets has opposite front and rear ends. A shaft is mounted rotatably on the rear ends of the brackets, and extends in a transverse direction relative to the longitudinal direction. An operating lever is secured to the shaft for turning the shaft. The chair further includes a linkage unit and an arm spacer. The linkage unit interconnects the seat and the footrest, and includes a pair of crank mechanisms disposed at the left and right sides of the seat, respectively. Each of the crank mechanisms includes a first crank arm having a rear end pivoted to the front end of a respective one of the brackets 21 and a front end opposite to the rear end thereof, a second crank arm having a front end pivoted to the footrest and a rear end pivoted to the front end of the first crank arm, a third crank arm fixed to and extending transversely from the shaft and having a pivot end distal from the shaft, and a fourth crank arm having opposite front and rear ends respectively pivoted to the footrest and the pivot end of the third crank arm such that rotation of the shaft via actuation of the operating lever results in turning of the third crank arm via the shaft, thereby permitting extension and retraction of the linkage unit relative to the seat between folding and extended positions. The first and second crank arms are spaced apart from and are generally parallel to the third and fourth crank arms. The arm spacer has a fixed end fixed to one of the first and fourth crank arms, and a pivot end that extends from the fixed end and that is pivoted to the other one of the first and fourth crank arms so that the first crank arm and the second crank arm cooperatively define a first gap in the longitudinal direction therebetween, and that the third crank arm and the fourth crank arm cooperatively define a second gap in the longitudinal direction therebetween when the linkage unit is positioned at the folding position, thereby preventing clamping of a user's finger when the linkage unit is moved from the extended position to the folding position.

BRIEF DESCRIPTION OF THE DRAWINGS

Other features and advantages of this invention will become more apparent in the following detailed description of the preferred embodiment of this invention, with reference to the accompanying drawing, in which.

DETAILED DESCRIPTION OF THE PREFERRED EMBODIMENT

Figure 1:
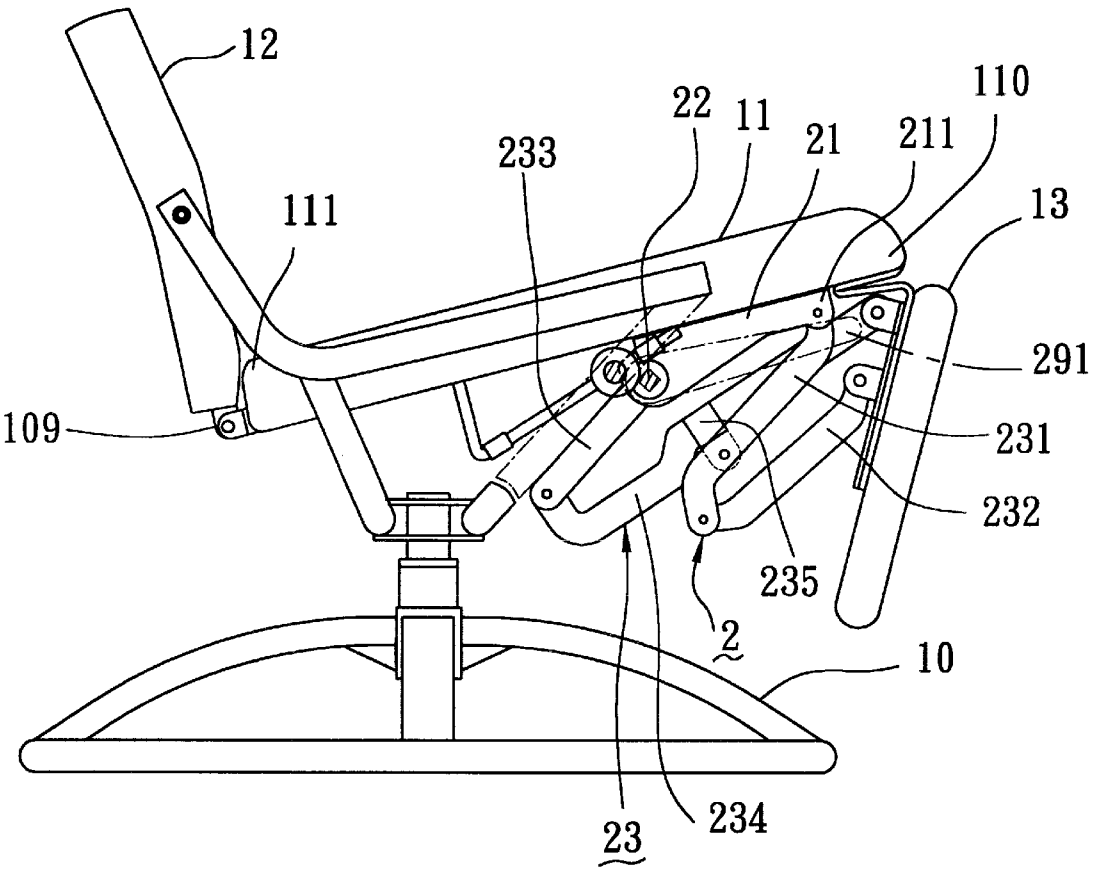
FIG. 1 is a schematic side view of a preferred embodiment of a chair according to the present invention, illustrating a linkage unit at a retracted position relative to a seat.
Figure 2:
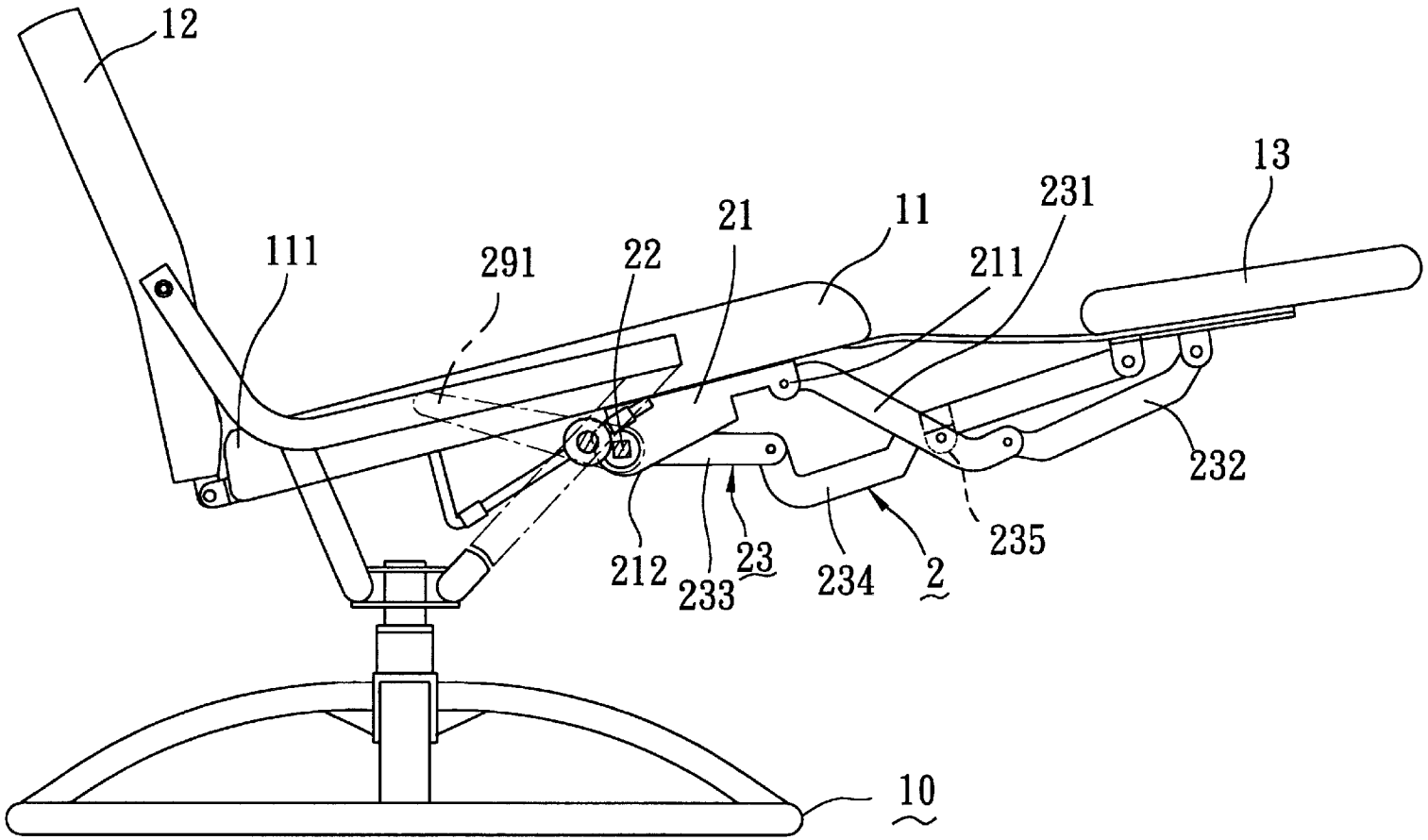
FIG. 2 is a schematic side view of the preferred embodiment, illustrating the linkage unit at an extended position relative to the seat.
Figure 3:
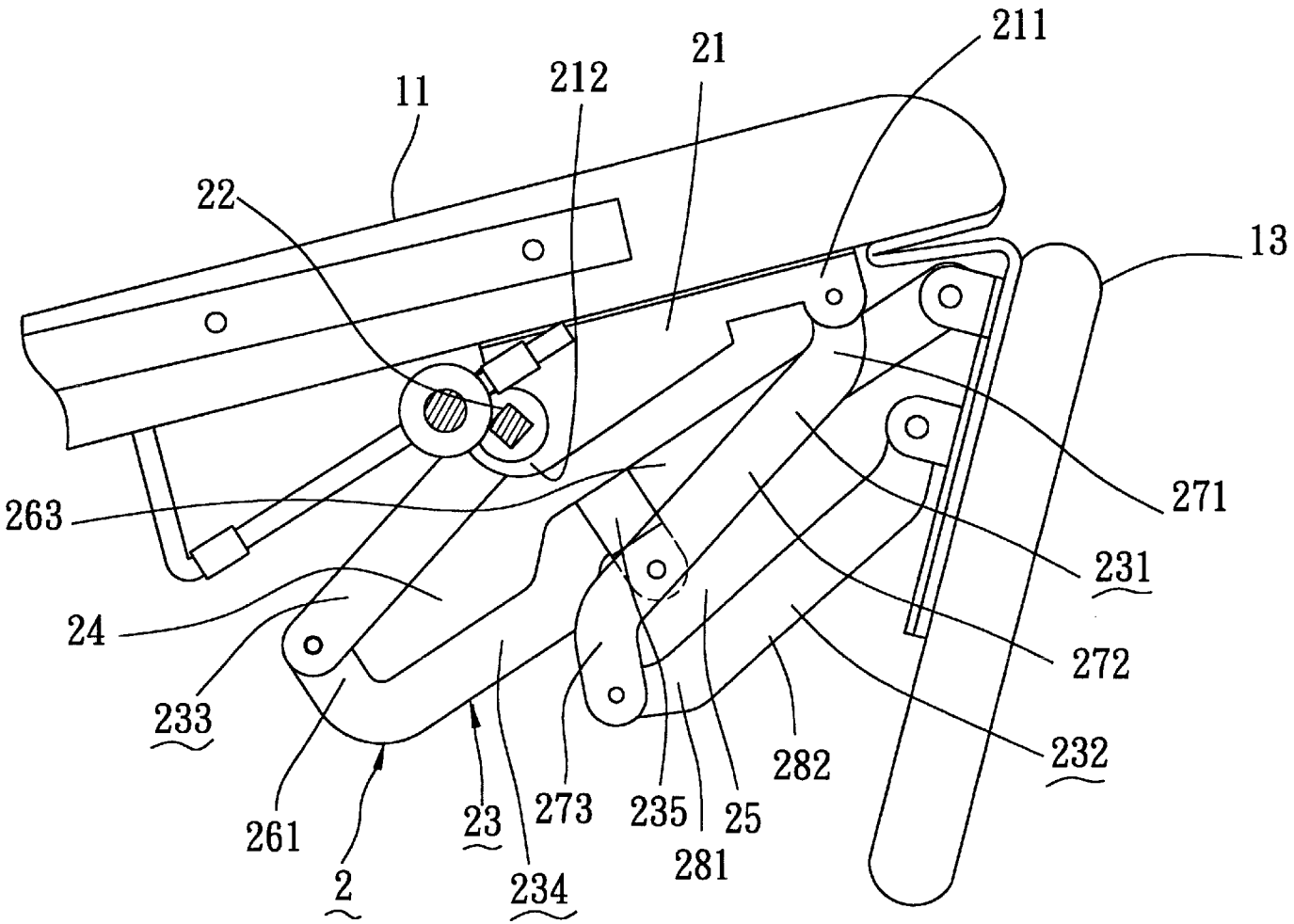
FIG. 3 is a fragmentary and enlarged side view of the preferred embodiment shown in FIG. 1.

Referring to FIGS. 1 to 3, the preferred embodiment of a chair according to the present invention is shown to include a seat base 10, a slidable seat 11, a backrest 12, a footrest 13, a linkage mounting unit, a linkage unit 2, and an arm spacer 235.

As illustrated, the seat 11 is mounted on the seat base 10, extends in a longitudinal direction, and has left and right sides, front and rear ends 110, 111, and a bottom.

The backrest 12 is disposed rearwardly of the seat 11, and has a lower end connected pivotally to the rear end 111 of the seat 11 about a horizontal pivot 109.

The footrest 13 is disposed frontwardly of the seat 11.

The linkage mounting unit includes left and right brackets 21 fixed to the bottom of the seat 11, and extending in the longitudinal direction. Each of the brackets 21 has opposite front and rear ends 211, 212. A shaft 22 is mounted rotatably on the rear ends 212 of the brackets 21, and extends in a transverse direction relative to the longitudinal direction. An operating lever 291 is secured to the shaft 22 for turning the shaft 22.

The linkage unit 2 interconnects the seat 11 and the footrest 13, and includes a pair of crank mechanisms 23 disposed at the left and right sides of the seat 11, respectively. Each of the crank mechanisms 23 includes a first crank arm 231, a second crank arm 232, a third crank arm 233, and a fourth crank arm 234. The first crank arm 231 has a rear end 271 pivoted to the front end 211 of a respective one of the brackets 21, and a front end 273 opposite to the rear end 271. The second crank arm 232 has a front end pivoted to the footrest 13 and a rear end 281 pivoted to the front end 273 of the first crank arm 231. The third crank arm 233 is fixed to and extends transversely from the shaft 22, and has a pivot end distal from the shaft 22. The fourth crank arm 234 has opposite front and rear ends 264, 261 respectively pivoted to the footrest 13 and the pivot end of the third crank arm 233. As such, rotation of the shaft 22 via actuation of the operating lever 291 results in turning of the third crank arm 233 via the shaft 22, thereby permitting extension and retraction of the linkage unit 2 relative to the seat 11 between folding and extended positions, as best shown in FIGS. 1 and 2, respectively. At the folding and extended positions, the first and second crank arms 231, 232 are spaced apart from and are generally parallel to the third and fourth crank arms 233, 234.

The arm spacer 235 has a fixed end 235F (see FIG. 4) fixed to the fourth crank arm 234 and a pivot end 235P that extends from the fixed end 235F and that is pivoted to the first crank arm 231 such that the first crank arm 231 and the second crank arm 232 cooperatively define a first gap 25 in the longitudinal direction therebetween, and that the third crank arm 233 and the fourth crank arm 234 cooperatively define a second gap 24 in the longitudinal direction therebetween when the linkage unit 2 is positioned at the folding position, as best shown in FIG. 3, thereby preventing clamping of a user's finger when the linkage unit 2 is moved from the extended position of FIG. 2 to the folding position of FIGS. 1 and 3.

Figure 4:
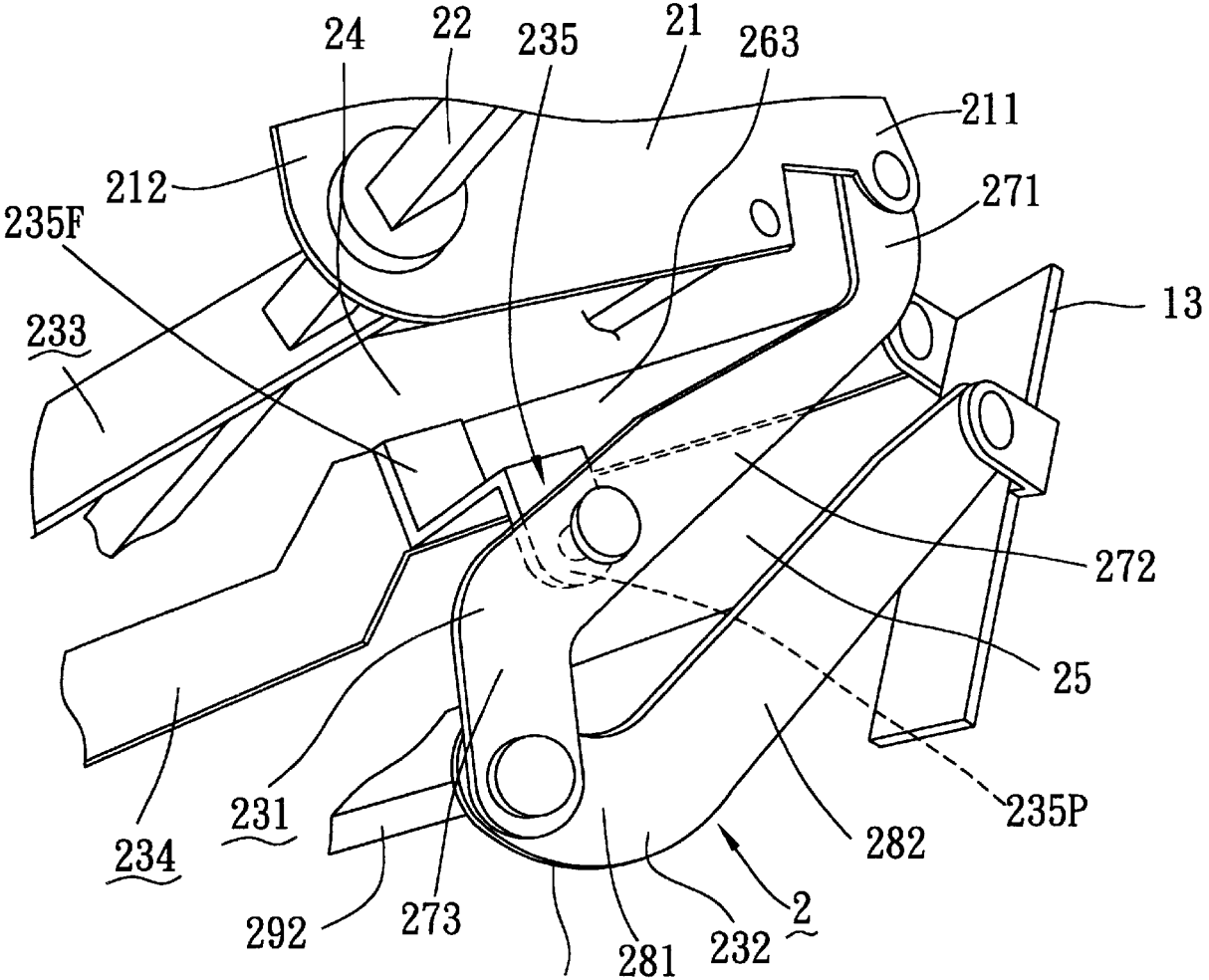
FIG. 4 is a fragmentary and enlarged bottom view of the preferred embodiment, illustrating how first and fourth crank arms employed therein are spaced apart from each other.

Referring to FIG. 4, the first crank arm 231 has an intermediate straight portion 272. The front and rear ends 273, 271 of the first crank arm 231 are bent relative to the intermediate straight portion 272. The second crank arm 232 has an intermediate straight portion 282. The rear end 281 of the second crank arm 232 is bent relative to the intermediate straight portion 282 so as to define the first gap 25 between the intermediate straight portions 272, 282 of the first and second crank arms 231, 232 when the linkage unit 2 is positioned at the folding position. The fourth crank arm 234 has a front straight portion 263. The rear end 261 of the fourth crank arm 234 is L-shaped and bent relative to the front straight portion 263 so as to define the second gap 24 between the front straight portion 263 of the fourth crank arm 234 and the third crank arm 233 when the linkage unit 2 is positioned at the folding position.

Figure 5:
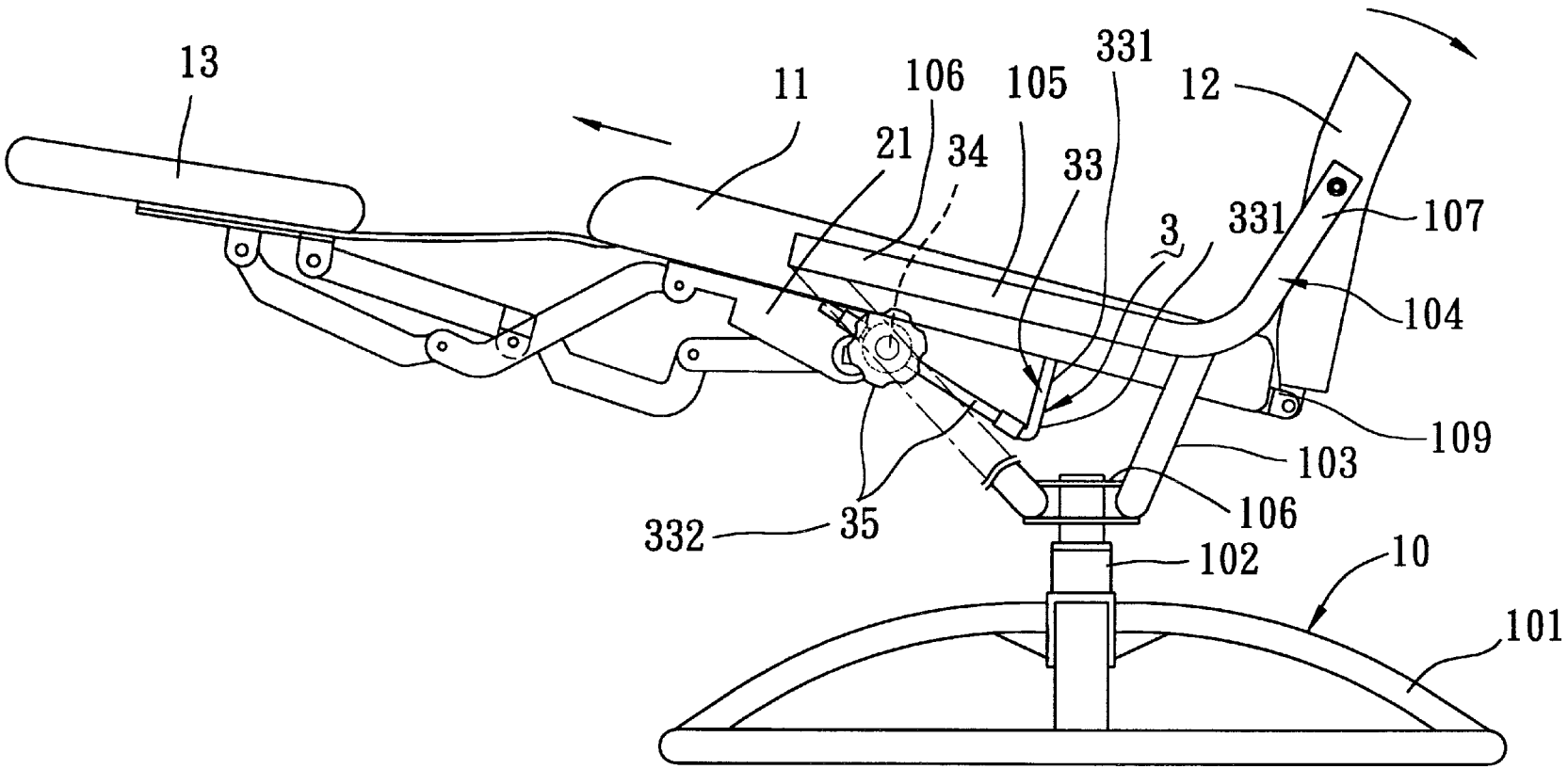
FIG. 5 is a schematic side view of the preferred embodiment, illustrating the state of a backrest relative to the seat prior to adjustment.
Figure 6:
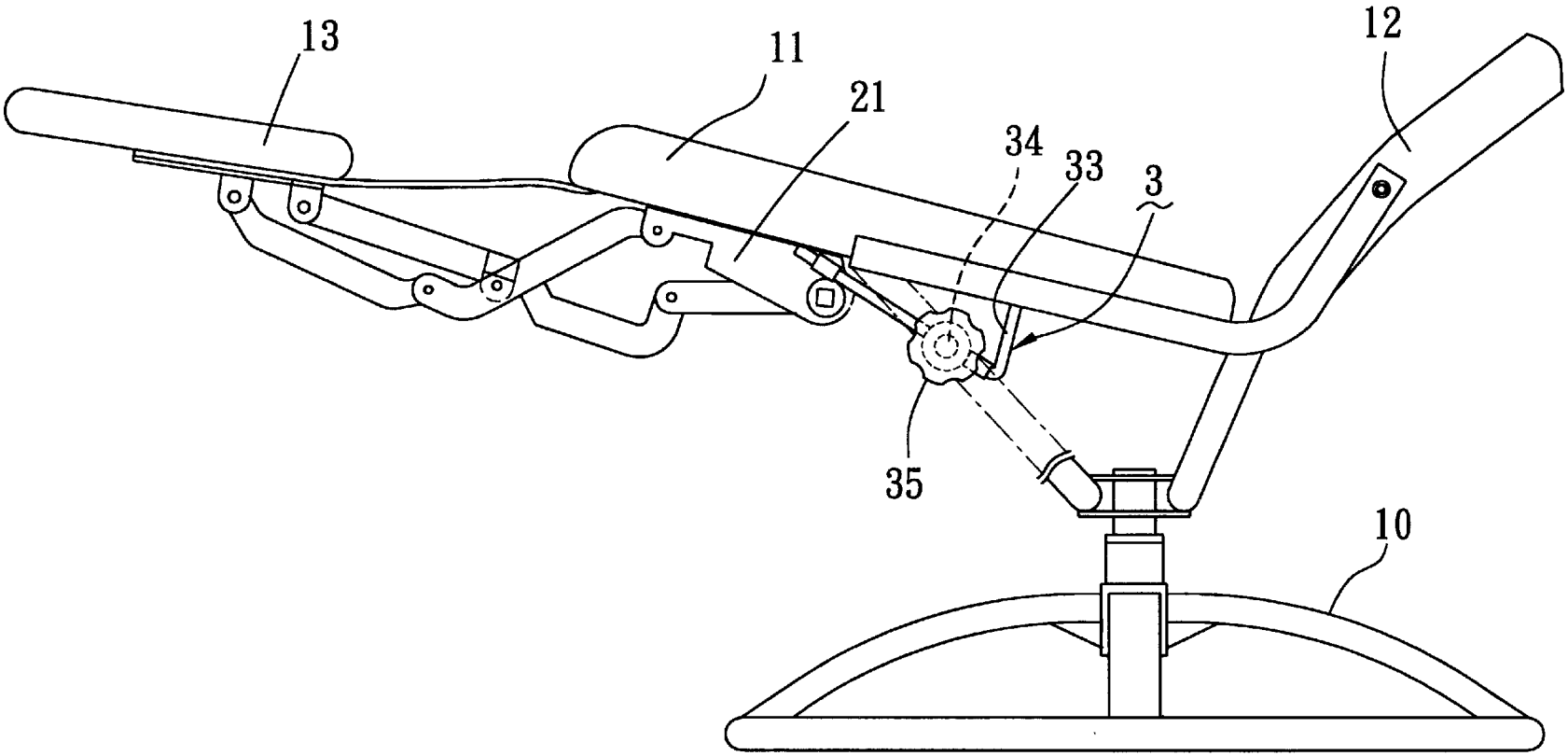
FIG. 6 is a schematic side view of the preferred embodiment, illustrating the state of the backrest relative to the seat after an inclination adjustment.

Referring to FIGS. 5 and 6, the seat base 10 includes a circular foundation 101 disposed on a floor surface, an upright post 102 rotatably mounted on the foundation 101, and a seat mounting unit 104 fixed onto the post 102 for co-rotation therewith relative to the foundation 101. The seat mounting unit 104 includes left and right tubular frame parts 103 fixed onto the post 102 via two fixing elements 108, and left and right L-shaped frame parts 105. Each of the L-shaped frame parts 105 includes a horizontal portion 106 that is secured to a respective one of the tubular frame parts 103, and a vertical portion 107 that extends from the horizontal portion 106 and that is pivoted to the backrest 12 above the horizontal pivot 109. The invention further includes an angle adjusting unit 3 which includes a transverse rod 34, left and right L-shaped slide rods 33, and a fastener knob 35. The transverse rod 34 is fixed to the left and right tubular frame parts 103, extends in the transverse direction, and is formed with two slide holes. The left and right L-shaped slide rods 33 are secured to the bottom of the seat 11. Each of the left and right L-shaped slide rods 33 has a short rod section 331 that is secured to the bottom of the seat 11 and that is disposed rearwardly of the transverse rod 34, and a long rod section 332 that extends frontwardly and upwardly from the short rod section 331 through a respective one of the slide holes in the transverse. rod 34. As such, pivotal action of the backrest 12 relative to the seat 11 results in frontward and rearward movement of the slide rods 33 together with the seat 11 relative to the transverse rod 34. The fastener knob 35 is mounted threadedly on the transverse rod 34, and is movable between a locking position, in which the fastener knob 35 moves toward and abuts against a respective one of the slide rods 33, thereby immobilizing the seat 11 relative to the seat base 10, and an unlocking position, in which the fastener knob 35 moves away and disengages from the respective one of the slide rods 33, thereby permitting synchronous movement of the backrest 12 and the seat 11 relative to the seat base 10.

With this invention thus explained, it is apparent that numerous modifications and variations can be made without departing from the scope and spirit of this invention. It is therefore intended that the invention be limited only as indicated in the appended claims.

I claim:

1. A chair comprising:

a seat base;

a seat mounted on said seat base and extending in a longitudinal direction, and having left and right sides, front and rear ends, and a bottom;

a backrest disposed rearwardly of and connected to said seat;

a footrest disposed frontwardly of said seat;

a linkage mounting unit including left and right brackets fixed to said bottom of said seat and extending in said longitudinal direction, each of said brackets having opposite front and rear ends;

a shaft mounted rotatably on said rear ends of said brackets and extending in a transverse direction relative to said longitudinal direction;

an operating lever secured to said shaft for turning said shaft;

a linkage unit interconnecting said seat and said footrest, and including a pair of crank mechanisms disposed at said left and right sides of said seat, respectively, each of said crank mechanisms 23 including a first crank arm having a rear end pivoted to said front end of a respective one of said brackets and a front end opposite to said rear end thereof, a second crank arm having a front end pivoted to said footrest and a rear end pivoted to said front end of said first crank arm, a third crank arm fixed to and extending transversely from said shaft and having a pivot end distal from said shaft, and a fourth crank arm having opposite front and rear ends respectively pivoted to said footrest and said pivot end of said third crank arm such that rotation of said shaft via actuation of said operating lever results in turning of said third crank arm via said shaft, thereby permitting extension and retraction of said linkage unit relative to said seat between folding and extended positions, said first and second crank arms being spaced apart from and being generally parallel to said third and fourth crank arms; and an arm spacer having a fixed end fixed to one of said first and fourth crank arms, and a pivot end extending from said fixed end and pivoted to the other one of said first and fourth crank arms such that said first crank arm and said second crank arm cooperatively define a first gap in said longitudinal direction therebetween, and that said third crank arm and said fourth crank arm cooperatively define a second gap in said longitudinal direction therebetween when said linkage unit is positioned at said folding position thereby preventing clamping of a user's finger when said linkage unit is moved from the extended position to the folding position.

2. The chair as defined in claim 1, wherein said first crank arm has an intermediate straight portion, said front and rear ends of said first crank arm being bent relative to said intermediate straight portion, said second crank arm having an intermediate straight portion, said rear end of said second crank arm being bent relative to said intermediate straight portion so as to define the first gap between said intermediate straight portions of said first and second crank arms when said linkage unit is positioned at said folding position, said fourth crank arm having a front straight portion, said rear end of said fourth crank arm being L-shaped and bent relative to said front straight portion so as to define said second gap between said front straight portion of said fourth crank arm and said third crank arm when said linkage unit is positioned at said folding position.

3. The chair as defined in claim 2, wherein said backrest has a lower end pivoted to said rear end of said seat about a horizontal pivot, said chair further comprising a seat mounting unit including left and right tubular frame parts fixed on said seat base, and left and right L-shaped frame parts, each of said L-shaped frame parts including a horizontal portion that is secured to a respective one of said left and right tubular frame parts, and a vertical portion that extends from said horizontal portion and that is pivoted to said backrest above said horizontal pivot, said chair further comprising an angle adjusting unit which includes a transverse rod that is fixed to said left and right tubular frame parts, that extends in said transverse direction, and that is formed with two slide holes, and left and right L-shaped slide rods secured to said bottom of said seat, each of said slide rods having a short rod section secured to said bottom of said seat and disposed rearwardly of said transverse rod, and a long rod section extending frontwardly and upwardly from said short rod section through a respective one of said slide holes in said transverse rod such that pivotal action of said backrest relative to said seat results in frontward and rearward movement of said slide rods together with said seat relative to said transverse rod, said angle adjusting unit further including at least one fastener knob mounted threadedly on said transverse rod and movable between a locking position, in which said fastener knob moves toward and abuts against a respective one of said slide rods, thereby immobilizing said seat relative to said seat base, and an unlocking position, in which said fastener knob moves away and disengages from the respective one of said slide rods, thereby permitting synchronous movement of said backrest and said seat relative to said seat base.

* * * * *